US005392853A

United States Patent [19]

Toon

[11] Patent Number: 5,392,853

[45] Date of Patent: Feb. 28, 1995

[54] PLUGGING SYSTEM FOR BOREHOLES

[75] Inventor: Donald A. Toon, Burlington, Canada

[73] Assignee: Solinst Canada Ltd., Glen Williams, Canada

[21] Appl. No.: 981,418

[22] Filed: Nov. 25, 1992

[51] Int. Cl.[6] ..... E21B 33/00

[52] U.S. Cl. ..... 166/187

[58] Field of Search ..... 166/187, 191, 195, 196, 166/179, 77, 387

[56] References Cited

U.S. PATENT DOCUMENTS

| | | | |
|---|---|---|---|
| 2,922,478 | 1/1960 | Maly | 166/187 |
| 3,032,115 | 5/1962 | Smith | 166/187 |
| 3,289,761 | 12/1966 | Smith et al. | 166/187 |
| 3,493,045 | 2/1970 | Bassani | 166/187 |
| 4,440,226 | 4/1984 | Suman, Jr. | 166/187 X |

*Primary Examiner*—Thuy M. Bui

[57] ABSTRACT

The system prevents water flowing freely up and down an open borehole. A hose of stretch elastic rubber is inserted into the borehole and, once installed, is filled with water from the surface. The hose inflates and expands, plugging the borehole. Used with multi-level sampling apparatus, lengths of the hose plug the borehole between the sampling ports. The lengths of hose are mechanically supported between couplings by means of stiff plastic hose passing inside the hose, between the couplings.

9 Claims, 6 Drawing Sheets

PLUGGING SYSTEM FOR BOREHOLES

This invention relates to the sealing or packing of in-ground boreholes.

When drawing samples of water from a borehole, the requirement often arises for the engineer to draw samples from different levels in the borehole; often also, the requirement arises that the engineer must be sure that water in the sample has come from the intended level, and has not leaded from some other level.

The invention provides a means for sealing or plugging a borehole, whereby samples may be drawn from various depths or levels of the borehole, substantially without the concern that water may be traversing vertically from sampling point to sampling point, within the borehole.

The invention is particularly suited to the case where the borehole is to be used only temporarily for the purpose of taking samples. After the samples have been drawn, over a period for example of a few months, the sampling apparatus is withdrawn from the borehole. Perhaps, the borehold may then be abandoned, or it may be used as a well, etc. One of the conventional difficulties of taking samples from a borehole on a one-time basis is that often the sampling apparatus, once it has been sealed into the borehole, cannot then be removed and the apparatus has had to be abandoned. The invention enables the borehold to be sealed very effectively, and yet enables the sampling apparatus to be readily removed upon completion of sampling.

It may be noted, in cases where the apparatus is to be left permanently in the borehole, that the quality of the materials should be suitable for that usage; where the apparatus is to be used only temporarily, materials can be selected more for qualities other than service durability, as will be explained.

The invention is also advantageous in the case where the borehole is not at present being used for the purpose of taking samples, not indeed for any purpose, but where the borehole will be used at some time in the future. In this case, a requirement can arise that the borehole be maintained sealed or plugged, to prevent a vertical transfer of water up and down the borehole, being a vertical transfer between, for example, different strata of the aquifer, oversoil, bedrock, etc. Again, the requirement then arises that the plug or seal be easily and completely removeable.

DETAILED DESCRIPTION OF PREFERRED EMBODIMENT

By way of further explanation of the invention, exemplary embodiments of the invention will now be described with reference to the accompanying drawings, in which.

The structures and procedures shown in the accompanying drawings and described below are examples which embody the invention. It should be noted that the scope of the invention is defined by the accompanying claims, and not necessarily by specific features of exemplary embodiments.

Figure 1:
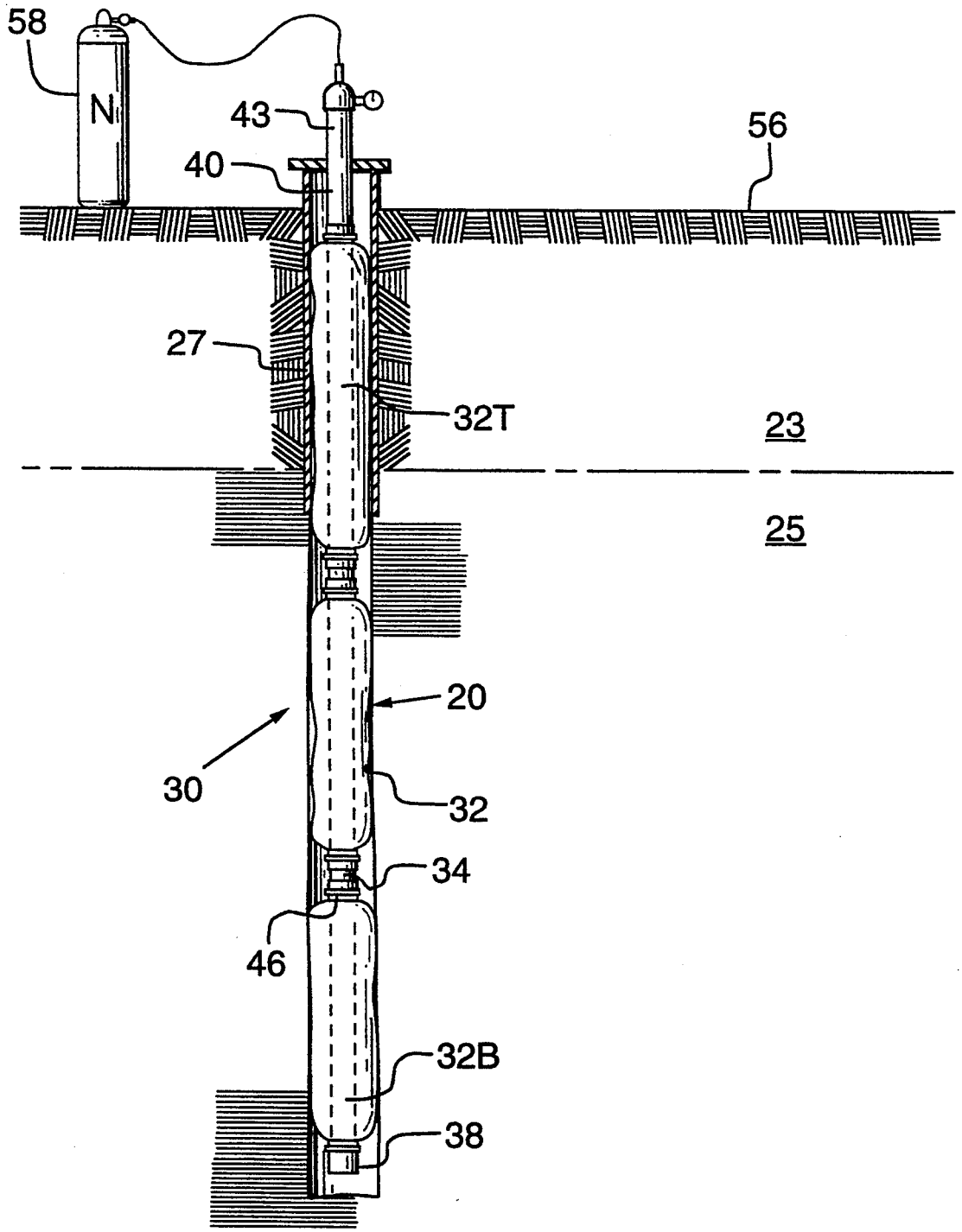
FIG. 1 is a cross-sectional elevation of a borehole in the ground, in which is present a maintenance seal/plug system which incorporates the invention.

As shown in FIG. 1, a borehole 20 extends down into the ground, in this case through unconsolidated material 23, and into consolidated material 25 below. The unconsolidated material cannot be relied upon not to collapse into the borehole, and a liner or casing 27 defines the borehole in the unconsolidated material.

The liner 27 protrudes out of the borehole at the surface, and provides a means whereby items inserted into the borehole can be supported, braced, sealed, etc, with respect to the borehole 20.

The borehole 20 in this examples is not in use for the present. While awaiting operations use, however, it is desirable that the hole be plugged. Plugging the hole keeps out foreign materials which may fall in from the surface, but more importantly, if the plug can be arranged to extend over the whole height or depth of the borehole, water can be prevented from traversing vertically along the borehole. Therefore, if it is later detected that a contaminant is present at level A, it can be declared that said contaminant must have come from level A, and cannot have simply flowed up the borehole from level B.

The borehole 20 contains a borehole-plugging system 30, which extends over the whole height of the borehole. The plugging system 30 includes a number of lengths 32 of elastomeric, flexible, hose material. The material of the elastic hose lengths 32 may be gum rubber, ie rubber which is substantially without reinforcing fibers and cords, and which has been vulcanised and treated to stretch elastically to many times its nominal dimensions. A preferred type of rubber is that known as black carbon rubber (BCR), which is not quite so stretchy as gum rubber, but is more durable.

The elastic hose lengths 32 are joined together by the use of coupling units 34. The coupling units 34 have a cylindrical register 36, to which the elastic hose lengths may be clamped. A corresponding bottom plug unit 38 is used at the bottom of the plugging system 30, to blank off the bottom elastic hose length 32B. A top unit 40 is used at the top of the system, to join the top elastic hose length 32T to a riser 43, which is made of rigid plastic.

The dimensions of the elastic hose lengths 32 of course can be as desired by the designer of the system, but the intention is that the lengths be long; that is to say, of the order of 20 meters or more.

The plugging system 30 as described is not intended to be used when the requirement is to seal the borehold over short distances. Other systems are available for that task, some of which may be more efficient in that task than the system as herein described. Often, in a short-distance-sealing-system, the seal is inflated or otherwise pressurized to a high pressure. The plugging system 30 is intended to be pressurised, but only to a low pressure; that is to say, to an excess of only a few psi over the natural borehole pressure.

The system 30 is intended to be used when the plugging system 30 is to occupy substantially every meter of the depth of the borehole, or at least to occupy every meter below the liner 27. In use of the system, each length 32 of flexible elastomeric hose is inflated, and fills the borehole over substantially its whole length; only the few centimeters of the borehole adjacent to the coupling units 34 are not filled and plugged.

Figure 2:
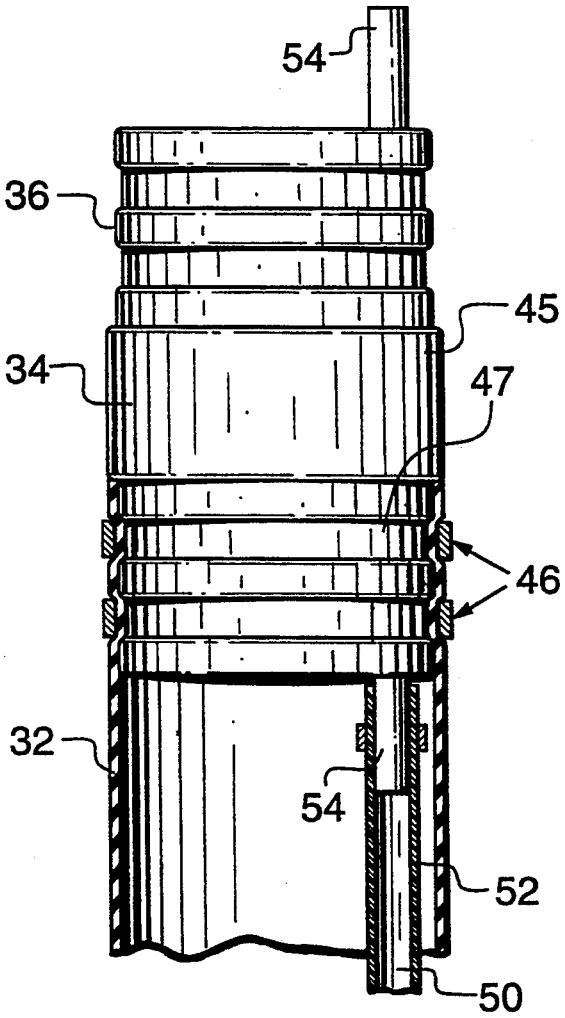
FIG. 2 is a close-up view of a portion of FIG. 1.

One of the coupling units 34 is shown in more detail in FIG. 2. The body of the unit comprises a short length of plastic (PVC) tube 45, in which, as mentioned, are formed cylindrical register 36. (Alternatively, the body may be of stainless steel.) The elastic hose lengths 32 are clamped to these registers in the conventional manner, by means of hose clamps 46. Grooves 47 in the registers 36 improve the mechanical security of the clamp.

The elastomeric material of the elastic hose lengths 32 is, as described, very stretchy. The design requires a material which, when inflated, will expand sufficiently to fill the borehole 20, and which will conform with some intimacy against the walls of the borehole. Being elastically stretchy enough to fulfill that requirement, however, the elastic hose length 32 is unable to support heavy weights. If the plugging system as a whole were to hang from the elastic hose lengths, the hose material, being highly elastic, would stretch. Even if the material did not rupture, it is recognised that it would be quite unsatisfactory to allow the elastomeric material to support the weight of the plugging system. Means are therefore provided to prevent such stretching of the elastic hose.

The plugging system 30 includes support struts 50 connected between the coupling units 34. In fact, if there were no support connection between the coupling units 34 other than the elastic hose lengths, because the elastomeric material of the hose lengths has substantially no stiffness, it would be very difficult to install the system in the borehole 20, by passing the components down into the borehole, because the engineer would have no indication whatever if, for example, one of the coupling units 34 had become snagged on a discontinuity in the borehole wall.

The support strut 50 comprises a length of (stiff) plastic tubing 52. The body 45 of the coupling unit 34 is provided with spigots 54, to which the tubing 52 is attached with clamps.

The purpose of the support strut 50 is to provide a robust mechanical connection spanning between the coupling units 34. The lengths 32 of elastic hose themselves are quite unsuitable for this purpose. The support struts 50 have sufficient rigidity to enable the coupling units 34 to remain, during installation and during operation, at the distance apart as specified by the designer.

On the other hand, the support struts 50 are not totally rigid. The support strut has the same nominal length as the elastic hose length 32 (ie 20 meters or more). If the strut 50 were rigid, then, when the plugging system 30 is being installed, the strut would have to extend straight up, out of the top of the borehole. This would be very impractical.

Figure 3:
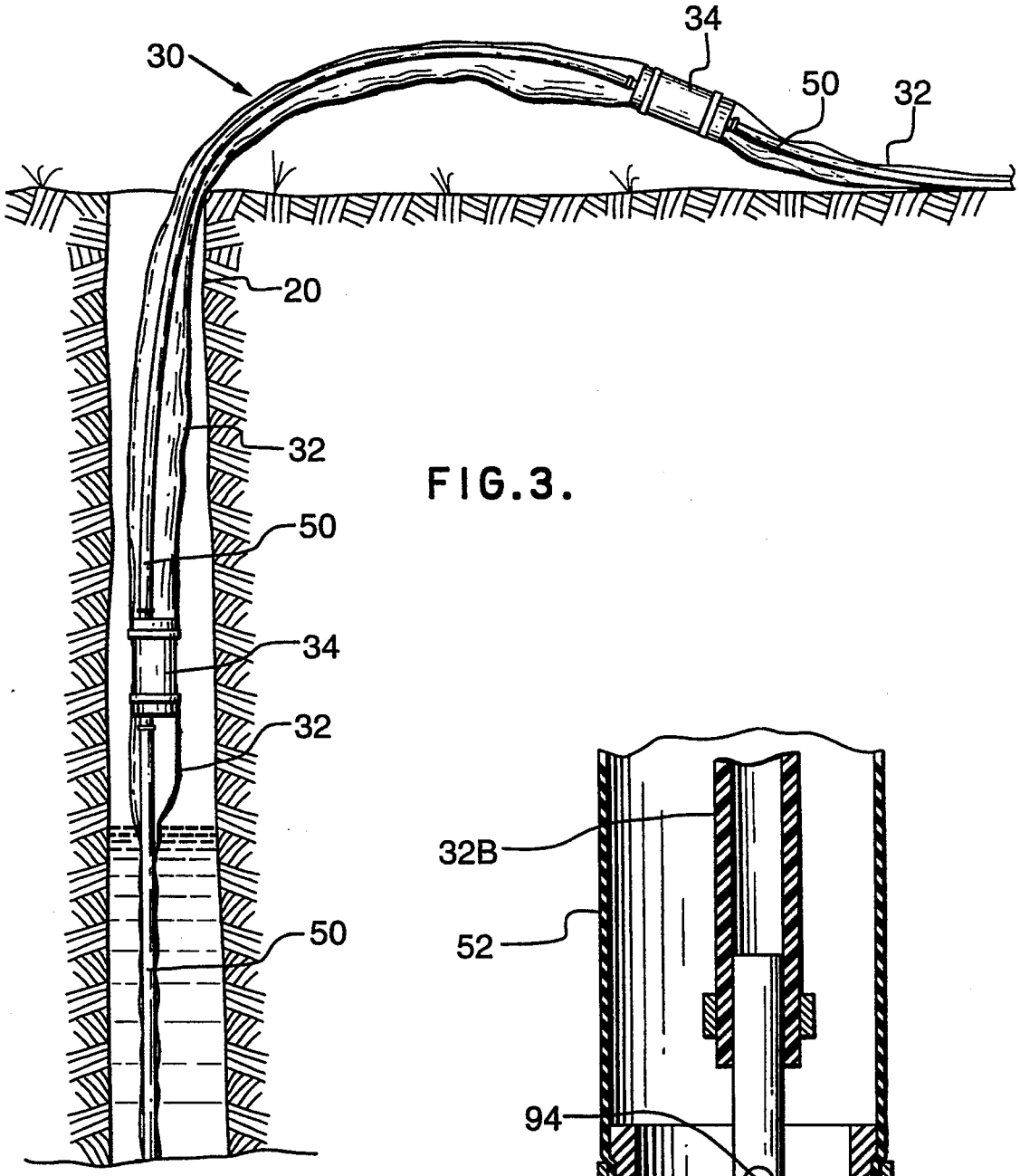
FIG. 3 is an elevation corresponding to FIG. 1, showing a stage during the installation of the system of FIG. 1.

The strut 50 therefore is flexible enough that, during installation of the plugging system, the strut can bend in the manner shown in FIG. 3. In FIG. 3, a lower portion of the elastic hose length 32 (and a portion of the strut 50) is already inserted in the borehole 20, but the strut is sufficiently flexible that much of the portion of the strut still outside the borehole can be laid flat on the ground surface 56.

Thus, firstly, the support strut 50 should be stiff enough and strong enough to constitute a robust mechanical connection between the coupling units 34, but the strut should also be flexible enough that the strut can bend during installation in the manner shown in FIG. 3. 12 mm nylon tubing having a wall thickness of 1.5 mm has been found to be satisfactory for the plastic tubing 52 of the support strut. In the context of the invention, plastic tubing having the above properties may be referred to as semi-rigid.

The procedure for installing the plugging system 20 involves passing the first elastic hose length 32B down into the borehole 20, the bottom plug unit 38 being attached to the bottom of the elastic hose. A support strut 50B is attached to the plug unit 38. The elastic hose length 32B, with the support strut 50B positioned inside, is lowered into the borehole. When almost the full length of the elastic hose length 32B has been lowered into the borehole, a coupling unit 32 is attached to the free upper end of the elastic hose length 32B and to the free upper end of the strut 50B. A fresh elastic hose length 32 and support strut 50 are then attached to the coupling unit 32, and lowered into the hole. When all the elastic hose lengths,struts, and coupling units have been lowered into the hole, the top of the riser 43 is left protruding out of the borehole 20.

The elastic hose lengths 32 are empty at this time. During installation, once the elastic hose lengths pass below the level of the water in the borehole, the pressure of the water in the borehole collapses the elastic hose. When installation is complete, water is poured into the elastic hose lengths from above. The water fills the elastic hose lengths, which expand. The elastic hose expands unit it touches the sides or walls of the borehole.

The water inside the elastic hose lengths is at a higher pressure than the water in the borehole once the water level in the hose lengths is higher than that in the borehole. The water in the elastic hoses may be pressurised further by means of a suitable gas (nitrogen) tank 58 and its associated values and fittings.

When the elastic hoses are to be pressurised using gas, the hoses should still be filled with water to a level above that in the borehole, so that the pressure difference between the inside and the outside of the elastic hoses is the same all the way down the plugging system. The elastic hoses should not be filled with gas; one of the dangers that can arise in a pressurised plugging system, especially when the material of the hoses is very stretch, is that the material might tend to balloon out into any fissures that may be present in the walls of the borehole. By keeping the pressure in the elastic hoses only marginally higher than the pressure in the borehole, over the whole height of the system, ballooning of the elastic hoses into fissures is not a problem.

(Sometimes, however, a borehole needs to be plugged over its whole depth, but the borehole does not contain water; for example, if a dry borehole has fissures through which gases may be seeping. In this case, the elastic hoses should preferably not be filled with water, but should contain only gas).

The plugging system 30 shown in FIG. 1, therefore, is effective to plug or seal the whole length (height) of the borehole 20. Water simply cannot traverse up and down the borehole to any degree at all. It should be emphasised that the plugging system 30 as described is not a series of may discrete short packers placed at different levels; the plugging system as described is effective to provide plugging contact with the walls of the borehole at a substantially uniform pressure differential, over the whole height or depth of the borehole 20. It may be noted that this full-height plugging function is achieved without the need to place water-swellable sealing material (such as bentonite) into the borehole.

The plugging system 30 can be easily removed from the borehole 20 when necessary; it is a simple matter to draw the water out of the elastic hose lengths 32, collapsing same, and allowing the hose lengths then to be withdrawn. It may be noted that when the plugging system 30 is removed, the borehole 20 is left clean and free from any traces of sealant or other introduced material.

Figure 9:
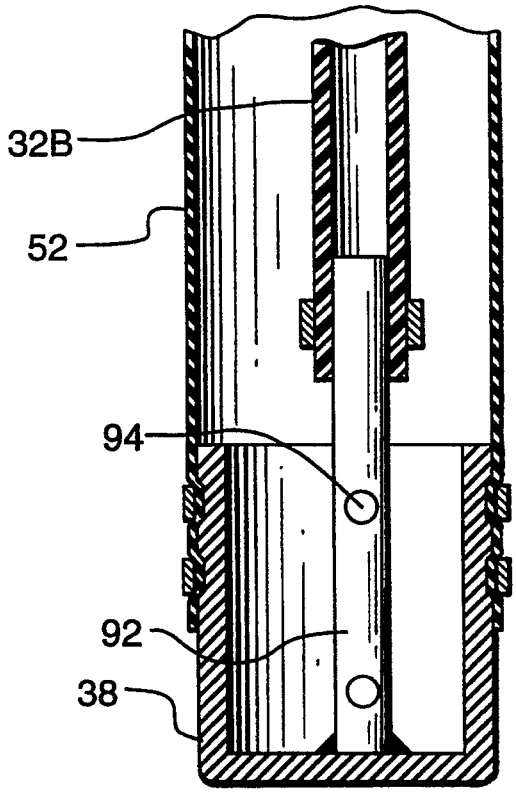
FIG. 9 is a close-up view of a portion of FIG. 1.

FIG. 9 shows a preferred means for extracting the water from inside the flexible hose when the time comes to remove the system from the borehole. A spigot-tube 92 is attached to the body of the bottom plug unit 38, and the plastic tubing 52 of the support strut 50 is clamped to the spigot-tube 92. The tubing 52, and the spigots, can all be hollow, thereby creating a passage which communicates with the surface. To remove the water from inside the flexible hose, a pulse of compressed air is sent down the said passage, emerging from the holes 94 in the spigot-tube, and blasting the water out of the flexible hose and out of the borehole. The flexible hose then collapses, allowing the apparatus to be withdrawn.

Figure 4:
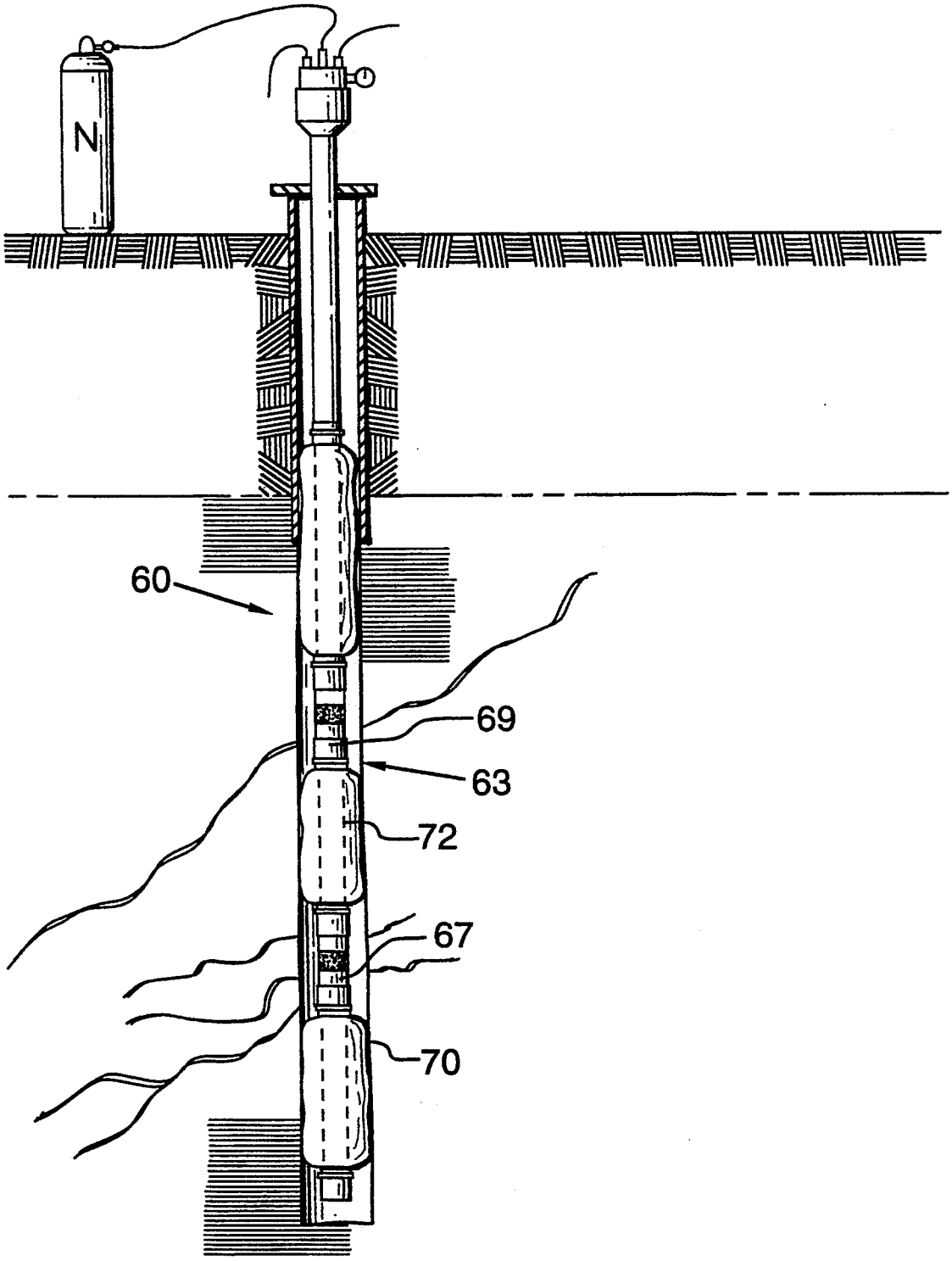
FIG. 4 is an elevation corresponding to FIG. 1, showing a sealing system being used in conjunction with a multi-level sampling apparatus.

The plugging system 60 shown in FIG. 4 is similar to that of FIG. 1, except that the system has been modified for use in a borehole 63 from which samples are being taken from different levels.

In multi-level sampling, as in FIG. 4, it is important that packing seals be provided to seal the borehole between the sampling levels. The borehole itself of course is an open hole, and water can and will traverse vertically up and down the borehole in complete freedom (quite unlike the natural situation) unless precautions are taken. If samples are being taken from levels paced, say, 20 meters apart, then the samples would lose much of their value if the borehole between the sampling levels were wide open, whereby water could simply and directly pass from one level to another.

In fact, it is often desired not just that the water cannot pass freely up and down the borehole, but that the water cannot pass at all. In a case, for example, of evidence being given of a contaminant, it is often an advantage if the tribunal can be positively assured that a contaminant detected at one level cannot possibly have seeped there, along the borehole, from another level. Therefore, the requirement for effective sealing or packing between levels can be very important in a multi-level sampling installation.

Different arrangements of packers and seals may be appropriate for different cases. For example, if the borehole 63 walls are reasonably smooth and firm, elastic hose lengths similar to those described in reference to FIG. 1 may be all that is required between the sampling levels. If the walls of the borehole are less secure, or if it cannot be determined what the walls of the borehole are like, the engineer may prefer to place a conventional short-length, high pressure packer above and below each sampling level, to make sure each sampling port really is isolated from the other levels. It is recognised that even with very secure, but short-length, packers in place close to the sampling port,it can be an advantage to plug the intervening height of the borehole, and the system as described is very suitable for that.

If the surrounding rock or aquifer material is somewhat porous, and if vertical traversing of water is taking place in same, then it is still best, from the sampling standpoint, to plug the borehole to ensure that traversing takes place without the assistance of a clear passage through an open borehole. Elastic hose lengths as described above may be inserted to plug the remainder of the height of the borehole, between the short-length packing seals. Thus, in a multi-level sampling operation, the plugging system of the invention may be used between the sampling ports, where or not additional short-length, high-pressure, highly-secure, packers, placed adjacent to the sampling ports, are also used.

FIG. 4 shows a system in which such short-length, highly secure, packing seals were not used. Only the plugging system 60 based on the use of long lengths of elastic hose is provided between the sampling levels.

A multi-level sampling system is complicated by the fact that the many sampling lines 65 from the various levels have to brought up to the surface. The sampling system includes sampling ports 67, which in this case are built into coupling units 69 which serve to join the lengths 70 of elastic hose. Each sampling line 65 is a length of plastic (nylon) pipe which extends from the sampling port 67 to the surface.

The system of FIG. 4 follows the conventional practice, whereby the sampling lines 65 are continuous lengths of plastic (eg nylon) pipe. The various other items of the down-hole sampling equipment are threaded over the long bundle of sampling lines.

As an alternative to threading the components over the bundle of sampling lines, it would be possible to arrange that the several sampling lines each were made up of separate shorter lengths of pipe, ie pipe lengths equal in length to the elastic hose lengths 70, whereby the lengths of the sampling lines, like the hose lengths, would be attached to the coupling units 69. However, in that case, many joints would be required, which increases the possibility of leakage (and the possibility that the engineer cannot tell whether there is a leakage). It is normally not too troublesome, in fact, to thread the components over a long bundle of sampling lines.

Each sampling line 65 is therefore only attached to the one coupling unit 69 which contains its respective sampling port 67;the sampling lines are not physically attached to the other coupling units, but simply pass through those units.

As was the case with the FIG. 1 system, the lengths 70 of elastic hose are not capable themselves of physically supporting the components of the down-hole system. Again, support struts are required, in order to provide mechanical structure between the coupling units. In FIG. 4, support struts between the coupling units 69 comes from the provision of casings 72 which are substantially rigid, and are rigidly attached to the coupling units 69. The casings 72 are nearly the same diameter as the coupling units. The bundle of sampling lines 65 is housed inside the casing. The elastic hose lengths 70 are fitted over the casing lengths 72. Holes in the wall of the casing 72 allow water poured in from the surface to fill the elastic hose lengths 70, after the system is installed in the borehole.

Figure 5:
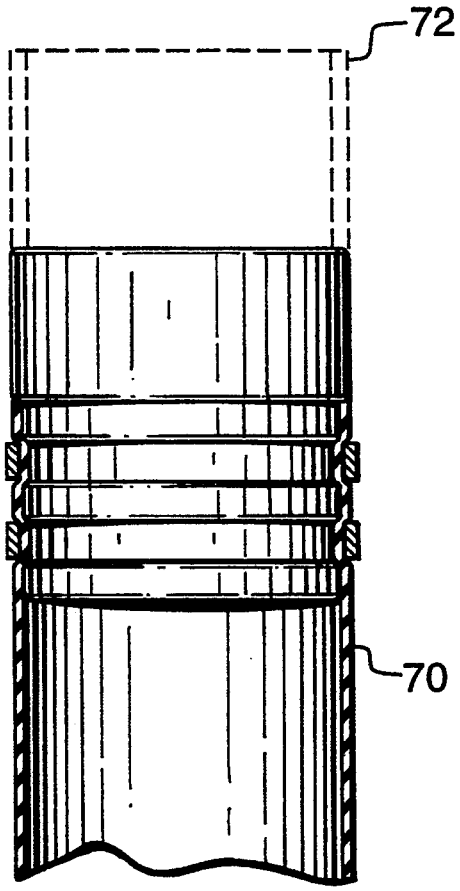
FIG. 5 is a close-up view of a portion of FIG. 4.

FIG. 5 is a detail of one of the coupling units 69.

Figure 6:
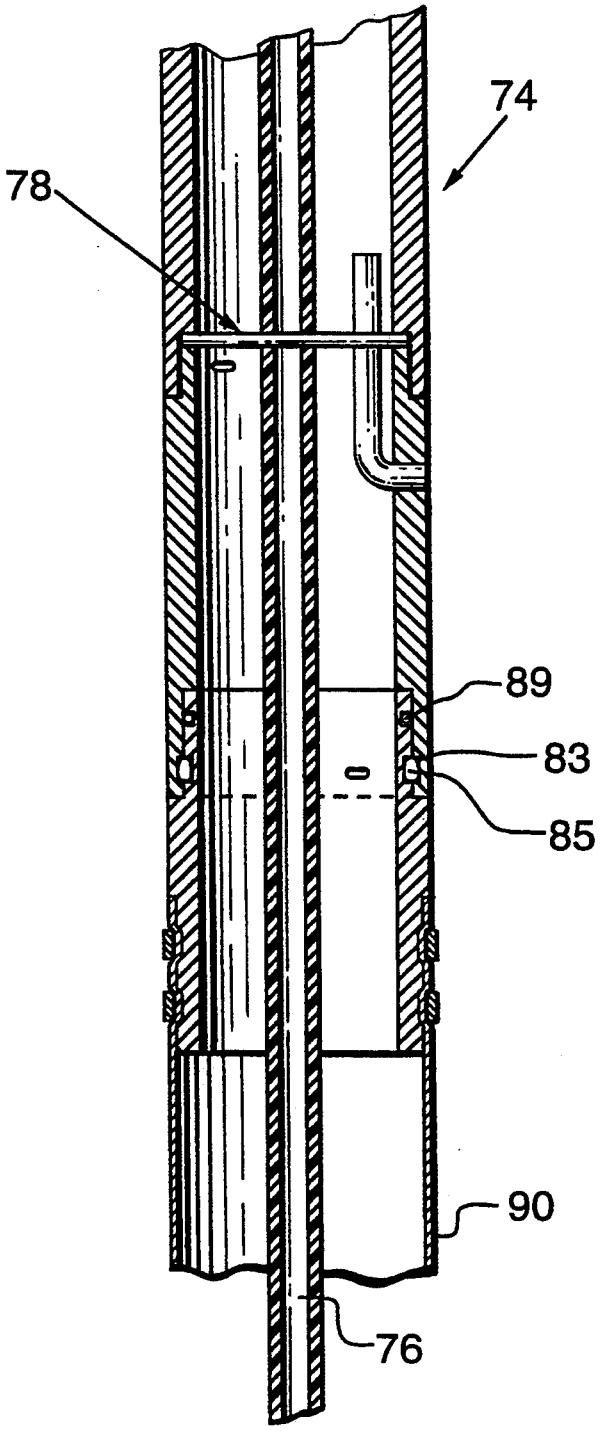
FIG. 6 is a close-up view corresponding to FIG. 5 of a portion of an alternative plugging system.
Figure 8:
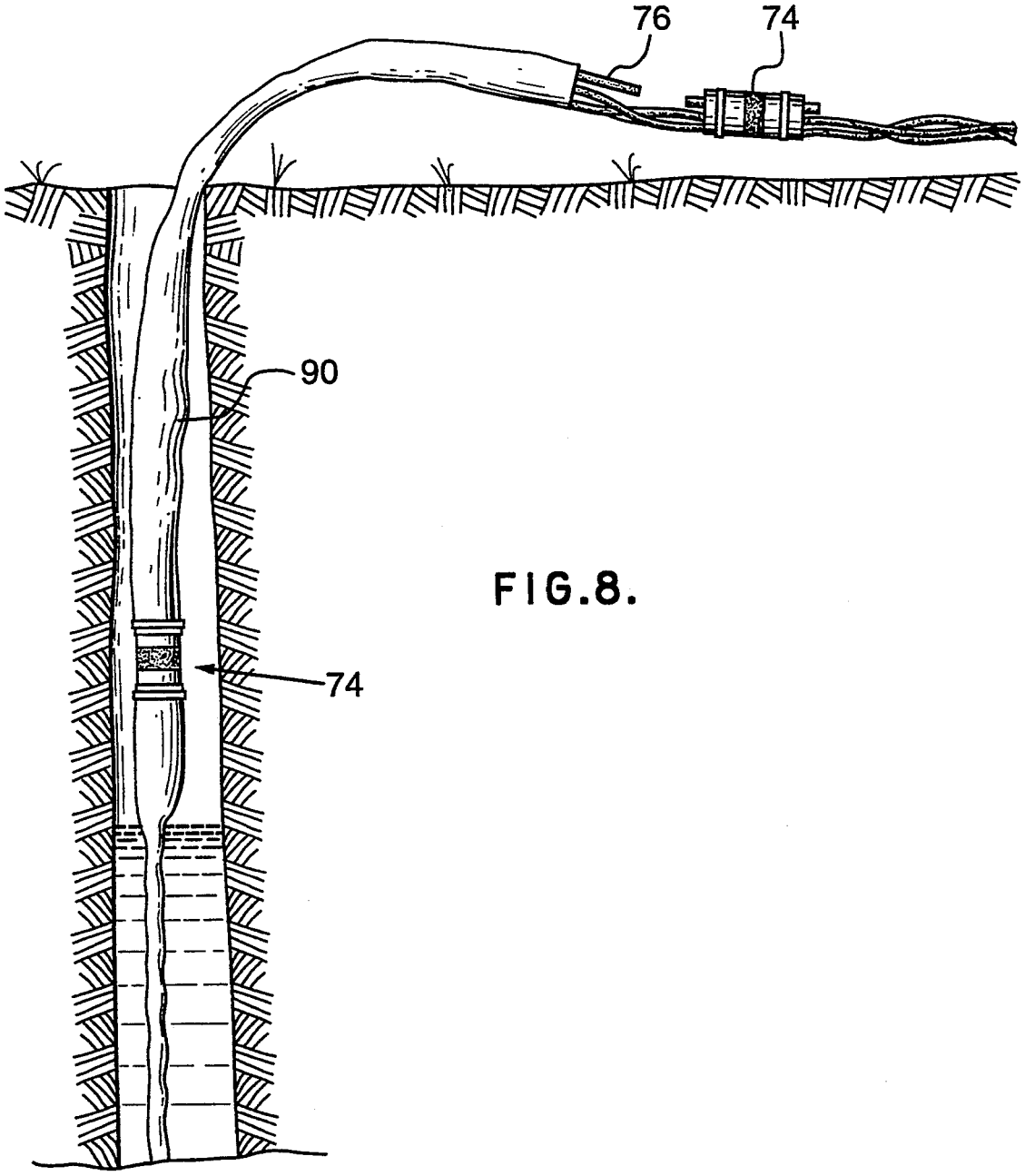
FIG. 8 is a view corresponding to FIG. 3 of the system of FIG. 6.

FIG. 6 shows a different arrangement for a multi-level sampling system. Here, there is no casing, and therefore some other means is required for providing mechanical structure between the coupling units 74. As in FIG. 1, in FIG. 6 the mechanical structure is provided by a semi-rigid plastic pipe 76. In FIG. 6, the plastic pipe 76 is continuous, ie not in individual lengths, and is attached to the coupling units 74 by means of the cross-bars 78 as shown. The cross-bar 78 passes through the plastic pipe 76, and engages complementary in recesses 80 formed in the body of the unit.

Figure 7:
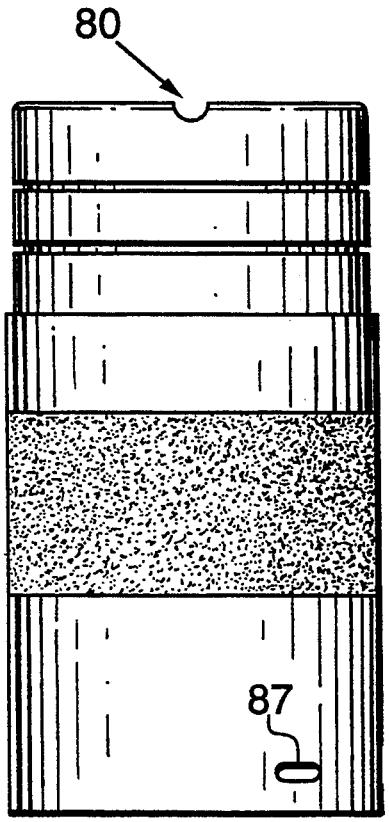
FIG. 7 shows a component of the system of FIG. 6.

FIG. 7 further illustrates the FIG. 6 arrangement. The components of the coupling unit 74 are joined together by means of a ring 83, which lies in a groove 85. The ring 83 is not a complete circle, and is adapted to be insertable into the groove 85 through a hole 87 in the wall of the coupling unit. An O-ring seal 89 is also provided, to prevent water inside the plugging system from contacting the water in the borehole.

Once installation is complete, the elastic hoses 90 are filled with water poured in from the surface, as described previously.

If it is required to withdraw the sampling system from the borehole at some later time, it is a simple matter to reverse the installation procedure; nothing has been placed in the borehole that cannot be completely and easily removed.

In the invention, the lengths of elastic hose are characterised as "long". The main intent of the invention is to provide a means for plugging a borehole which extends over substantially the whole height or depth of the borehole. Walls of boreholes are seldom smooth, and seldom complete, ie without fissures, small collapsed zones, etc. As a generality, and plugging system has to be inserted deflated, and has to be inflated once it is in position; conventional inflatable plugging systems have not been suitable for plugging very long continuous lengths, but have rather been suitable for packing short lengths, ie of a few centimeters; above and below a sampling point for example.

On the other hand, the desire for the borehole to be completely plugged has long been felt. This is demonstrated by the fact that engineers often attempt to plug a borehole by dropping pellets of bentonite into the annular space around a down-hole multi-level sampling apparatus, for instance. The unreliability of such needs no further comment, and furthermore it would be difficult later to remove the plug.

In the invention, the elastomeric material from which the elastic hose is made is characterised as stretchy to a high degree. It may be noted that conventional flexible hoses for conveying fluids are generally made from reinforced rubber (or reinforced elastomeric plastic). This conventional reinforcement is provided for the purpose of making the hose deflect only slightly when subjected to a high internal pressure. The elastomeric material used in the elastic hose of the invention, on the other hand, is much more stretch than that used in a reinforced, pressure-resistant, rubber (or elastomeric plastic) hose. Preferably, the material of the elastic hose will stretch elastically without damage to such an extent that the thickness of the material is at least halved.

The elastic hose of a typical borehole may have a diameter of, say, 5 cm, and have a wall thickness of, say, 1 mm. As such, the hose is floppy and virtually totally incapable of supporting itself (when not inflated); that is to say, the material of the elastic hose, if permitted to collapse under gravity, will do so, to the level of whatever the material happens to be resting upon.

The semi-rigid plastic tubing as described is thick-walled in relation to its diameter, and is made from a tough but non-brittle plastic, such as nylon. Preferably, the tubing is flexible enough to bend through a radius of about 1 meter; if bent tighter than that, the tubing would tend to crease or buckle. The tubing is resistant to buckling when subjected to forced directed along the length of the tubing; whereby the plugging system can be pushed down into the borehole, in some cases against the buoyancy of the system, by applying the push-down force to the tubing.

In an advantageous alternative to the systems as described, the apparatus is assembled fully under controlled in-factory conditions, and shipped out, virtually complete, to the borehole site.

Operations at boreholes are generally skilled labour-intensive. When the components to be inserted into a borehole are rigid, as they conventionally are, it is unavoidable that much of the assembly work of the apparatus has to be done actually at the borehole. But when the down-hole components are flexible, or semi-rigid as described, the components can be assembled in the factory, and shipped to the borehole site as a string, which is wound in the form of a coil. Of course, the curvature induced in the coil must be gentle enough, and the coupling units etc must be accommodated without being damaged in such a coil, but, with care, such a coil can be made serviceable; the care is required to be exercised in the factory, where it can be controlled, not at the borehole. At the borehole, the engineer simply unwinds the coil, and lowers the string of components down the borehole, all the joints and couplings having been made, assembled, and checked, back at the factory.

I claim:

1. Plugging system for an in-ground borehole, wherein:

the system includes at least one long length of tubular hose, having a length dimension of several meters;

the material of the hose is elastomeric, and is stretchy to a high degree;

the material of the hose is of such nature and dimensions as to be, in substance, floppy and incapable of physically supporting itself;

the system includes upper and lower coupling units;

each coupling unit is formed with a respective register which is suitable for receiving the upper and lower ends respectively of the length of hose;

the ends of the length of hose are sealingly attached to the registers;

the system includes a support strut, which has upper and lower ends, connected respectively to the upper and lower coupling units;

the support strut is effective, when the system is installed in the borehole, to physically support the coupling units with respect to each other, and is effective to hold the coupling units spaced apart at a pre-determined distance from each other;

and the system includes a means for conveying, when the system is installed in the borehole, a fluid from the surface to the interior of the length of hose.

2. System of claim 1, wherein the support strut is rigid enough to maintain the coupling units the said distance apart,but the support strut is flexible to the extent that,when a lowermost end of the support strut is in the borehole and an uppermost end of the support strut is outside the borehole, a portion of the support strut contiguous with the uppermost end thereof can lie flat on the ground.

3. System of claim 2, wherein the support strut comprises a length of semi-rigid plastic tubing, attached at its ends to complementary spigots on the respective coupling units.

4. System of claim 1, wherein:

the plugging system is suitable for use with a multi-level sampling system;

and one of the coupling joints includes a sampling port,which, when the system is installed in the borehole, is in operative communication with water in the borehole, at the level of the sampling port.

5. System of claim 4, wherein a sampling line extends from the sampling port, inside the elastic hose, to the surface.

6. System of claim 1, wherein the system is installed in the borehole, and the elastic hose is full of water poured in from above, the arrangement of the system being such that the said water the elastic hose is isolated from the water in the borehole.

7. System of claim 6, wherein the system includes means for pressurizing the said water in the elastic hose.

8. System of claim 1, wherein the system includes a means which is effective, when the system is installed in the borehole, for removing water from the hose;

the said means comprises a passage for conveying compressed air from the surface to the bottom of the system, and a means for discharging the compressed air at the bottom of the system, in a pulse of such vigour that water in the hose is thereby blasted out of the borehole.

9. System of claim 2, wherein the system includes a means for supporting and transporting a string of pre-assembled components, the components being the elastic hoses, the coupling units, and the support struts, the string being wound in a coil upon the said means, whereby the string of pre-assembled components can be lowered down into the borehole.

* * * * *